US008616674B2

(12) United States Patent
Takagi

(10) Patent No.: US 8,616,674 B2
(45) Date of Patent: Dec. 31, 2013

(54) PRINTING APPARATUS

(75) Inventor: Tetsuo Takagi, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 37 days.

(21) Appl. No.: 13/484,169

(22) Filed: May 30, 2012

(65) Prior Publication Data

US 2012/0306959 A1 Dec. 6, 2012

(30) Foreign Application Priority Data

Jun. 6, 2011 (JP) ..... 2011-125991

(51) Int. Cl.
*B41J 29/393* (2006.01)
*B41J 29/38* (2006.01)

(52) U.S. Cl.
USPC ..... 347/19; 347/14

(58) Field of Classification Search
CPC ..... B41J 2/17546
USPC ..... 347/5, 9, 14, 19, 50, 57, 58, 85
See application file for complete search history.

(56) References Cited

U.S. PATENT DOCUMENTS 4,401,999 A * 8/1983 Brown, Jr. ..... 347/142
7,364,252 B2 * 4/2008 Asauchi ..... 347/19
2007/0126770 A1 6/2007 Asauchi

FOREIGN PATENT DOCUMENTS

JP 05-299123 A 11/1993
JP 4539654 B2 7/2010

* cited by examiner

*Primary Examiner* — An Do
(74) *Attorney, Agent, or Firm* — Kilpatrick Townsend & Stockton LLP

(57) ABSTRACT

A printing apparatus includes a first detection terminal and a second detection terminal which contact with respective two first terminals of each of printing material containers; a third detection terminal and a fourth detection terminal which contact with respective two second terminals of each of the printing material containers; a first detection unit detects a first detection signal from the first detection terminal via a first attachment detection path; and a second detection unit detects a second detection signal from the third detection terminal via a second attachment detection path. The first detection unit detects a short circuit occurring between the second detection terminal and the third detection terminal on the basis of the second detection signal, and the second detection unit detects a short circuit occurring between the first detection terminal and the fourth detection terminal on the basis of the first detection signal.

6 Claims, 8 Drawing Sheets

PRINTING APPARATUS

BACKGROUND

1. Technical Field

The present invention relates to a printing apparatus or the like which can contain at least one printing material container attached thereto.

2. Related Art

Some known printing apparatuses, which contain at least one printing material container (ink container or the like) attached thereto, have a detection circuit configured to detect attributes and states of the at least one printing material container, such as a kind thereof and the presence or absence of the attachment thereof, and another circuit (a printing-material amount detection circuit) configured to detect whether the amount of a printing material contained in the at least one printing material container is more than or equal to a predetermined amount, or not. With respect to such a printing apparatus which is configured in such a manner as described above, known examples of a technology which enables prevention or suppression of occurrence of failures in the at least one printing material container and the printing apparatus due to any short circuit between the detection circuit and the printing-material amount detection circuit, include a technology described in Japanese Patent No. 4539654.

Further, known examples of a short-circuit protection circuit for a charging-type secondary battery pack having a remaining-amount indication function include a short-circuit protection circuit described in JP-A-5-299123.

This short-circuit protection circuit described in JP-A-5-299123 employs a method in which the presence or absence of an output electric current which arises upon occurrence of any short circuit is determined by measuring voltage-level changes of an electric-current detection resistor provided at the output portion of the secondary battery pack. But, it is to be noted that, in order to suppress loss of energy, the electric-current detection resistor needs to be of relatively low resistance. In this regard, however, the relatively low resistance of the electric-current detection resistor lowers a detected voltage level resulting from a current-to-voltage conversion, and thus, a determination circuit for determining whether any short circuit exists, or not, needs to be of higher accuracy.

In order to realize such a determination circuit of higher accuracy, a method of realizing the determination circuit by means of an analog circuit, which is configured to operate between a first power supply voltage (having a voltage level of, for example, 0V) and a second power supply voltage (having a voltage level of around several volts, that is, for example, approximately 3V to 5V), is employed. In such a circuit configuration, a short circuit is detected by measuring voltages of both terminals (two terminals) of the electric-current detection resistor. But, the voltage levels of the respective two terminals fluctuate, and thus, obviously, the fluctuations thereof cause a further variation in accuracy of the measurement.

Moreover, in the case where a high voltage (having a voltage level of, for example, approximately several ten volts) needs to be handled, a level conversion circuit is additionally needed, and thus, obviously, the addition of the level conversion circuit makes the circuit configuration further complicated.

Furthermore, since a protection circuit operates after the occurrence of a short circuit has been determined, a short-circuit electric current due to the short circuit is likely to flow even during a short period of time.

SUMMARY

An advantage of some aspects of the invention is to provide a printing apparatus which is capable of further highly accurately detecting normal conditions of contacts between terminals thereof, and any unintended short circuit occurring between terminals thereof which is likely to cause failures in the printing apparatus including at least one printing material container.

(1) According to an aspect of the invention, a printing apparatus includes at least one printing material container which includes two first terminals, two second terminals, an electric device connected to the two first terminals, and a wiring connecting the two second terminals to each other, and which is attachable and detachable to the printing apparatus; a first detection terminal and a second detection terminal which contact with the two first terminals, respectively, under the state where the at least one printing material container is attached to the printing apparatus; a third detection terminal and a fourth detection terminal which contact with the two second terminals, respectively, under the state where the at least one printing material container is attached to the printing apparatus; a first detection unit which is connected to the second detection terminal, and which detects contacts between the first and second detection terminals and the respective two first terminals by detecting a first detection signal, which is output from the first detection terminal, via a first attachment detection path including the electric device and the two first terminals; and a second detection unit which is connected to the fourth detection terminal, and which detects contacts between the third and fourth detection terminals and the respective two second terminals by detecting a second detection signal, which is output from the third detection terminal, via a second attachment detection path including the wiring and the two second terminals. Further, the first detection unit detects a short circuit occurring between the second detection terminal and the third detection terminal on the basis of the second detection signal, and the second detection unit detects a short circuit occurring between the first detection terminal and the fourth detection terminal on the basis of the first detection signal.

In the aspect of the invention, two kinds of signals used for the attachment detection, i.e., the first and second detection signals, are also used for the short-circuit detection, and when any short circuit occurring between terminals exists, a short-circuit detection signal (i.e., one of the first and second detection signals) is detected in preference to a contact detection signal (i.e., the other one of the first and second detection signals) which is to be detected under the normal condition. Therefore, it is possible to surely detect the short-circuit detection signal under the condition where any short circuit exists without shutting off any one of the first and second detection signals by means of a method of making the output port of any one of generation units for generating the first and second detection signals be in a high-impedance state, or the like. In addition, the short circuit occurring between the second detection terminal and the third detection terminal includes any short circuit which results in an electric conduction between the third detection terminal, from which the second detection signal is output, and the second detection terminal, to which the first detection unit is connected, and also includes any short circuit occurring between terminals at the printing material container side (refer to FIG. 6). Similarly, the short circuit occurring between the first detection terminal and the fourth detection terminal includes any short circuit which results in an electric conduction between the first detection terminal, from which the first detection signal is output, and the fourth detection terminal, to which the second detection unit is connected, and also includes any short circuit occurring between terminals at the printing material container side (refer to FIG. 7). Further, the individual detection signals can be detected on a digital processing basis. The two kinds of detection signals, i.e., the first and second detection signals, can be realized as, for example, pulse signals. Therefore, basically, any analog circuit of high accuracy is not needed.

Further, in the aspect of the invention, since the two kinds of detection signals, i.e., the first and second detection signals, are detected by the first and second detection units, it is unnecessary to connect any electric-current detection resistor, and thus, driving capabilities of the first and second detection signals are not degraded.

Further, in the aspect of the invention, the presence or absence of any short circuit is detected with reference to a predetermined electric potential (for example, a grounding potential). In each of the first and second detection units, for example, the presence or absence of any short circuit is detected by fixing one of both terminals of a current-to-voltage conversion resistor to a grounding potential, and detecting the changes of electric potential of the other one of the both terminals thereof. In this case, the presence or absence of any short circuit can be detected by measuring the changes of electric potential of only one of the both terminals of the current-to-voltage conversion resistor with reference to a predetermined electric potential (a grounding potential in the foregoing example). Therefore, the accuracy of the short-circuit detection is upgraded to a greater degree, as compared with the method in which the voltage changes of the both terminals of the electric-current detection resistor are detected.

(2) In the aspect of the invention, in the case where a path, via which the second detection signal output from the third detection terminal transmits to the first detection unit, is defined as a first short-circuit path, and a path, via which the first detection signal output from the first detection terminal transmits to the second detection unit, is defined as a second short-circuit path, preferably, an impedance of the first attachment detection path is larger than an impedance of the first short-circuit path, and an impedance of the second attachment detection path is larger than an impedance of the second short-circuit path.

If the electric-current driving capabilities of generation sources of the first and second detection signals are substantially equal to each other, the detection of the foregoing short-circuit detection signal, which is one of the first and second detection signals prevailing against the other one thereof, is made possible dependent on the largeness of each of the impedances of the first attachment detection path and the first short-circuit path, the impedances being ones when seen from the first detection unit. That is, if the impedance of the first attachment detection path is larger than the impedance of the first short-circuit path, the second detection signal prevails against the first detection signal.

Similarly, whether one of the first and second detection signals prevails against the other one thereof, or not, depends on the largeness of each of the impedances of the second attachment detection path and the second short-circuit path, the impedances being ones when seen from the second detection unit. That is, if the impedance of the second attachment detection path is larger than the impedance of the second short-circuit path, the first detection signal prevails against the second detection signal.

(3) In the aspect of the invention, preferably, the printing apparatus further includes an electric-current limitation resistor for limiting an amount of electric-current of the second detection signal output from the third detection terminal.

In this way, the impedances of the first and second attachment detection paths, as well as the impedances of the first and second short-circuit paths, can be appropriately set by utilizing a relatively large resistance of the electric device under the state where a short circuit exists between the first and third detection terminals, and the electric-current limitation resistor under the state where a short circuit exists between the second and fourth detection terminals, so that the electric-current driving capabilities of the first and second detection signals can be made adjustable; whereby it is possible to perform the short-circuit detection by detecting one of the first and second detection signals, which prevails against the other one thereof, as the short-circuit detection signal.

(4) In the aspect of the invention, preferably, the printing apparatus further includes an overvoltage detection unit configured to, when a high voltage having a voltage level higher than that of a voltage of the second detection signal is applied to the first detection terminal, detect whether a voltage having a voltage level higher than or equal to a predetermined voltage level is applied to at least one of the third detection terminal and the fourth detection terminal, or not.

In the aspect of the invention, in the case where at least one of a short circuit via a short-circuit resistance RSN (FIG. 6) and a short circuit via a short-circuit resistance RSP (FIG. 7) exists when a high voltage is applied, the overvoltage detection unit can detect the high voltage via at least one of a path including the short-circuit resistance RSN (FIG. 6) and the fourth detection terminal, and a path including the short-circuit resistance RSP (FIG. 7) and the third detection terminal. That is, independently of the short-circuit detection between terminals, as a preferable overvoltage protection operation, the overvoltage detection unit can promptly carry out an operation of lowering or shutting off the high voltage upon detection of, for example, a voltage having a range of a logic voltage level.

(5) In the aspect of the invention, preferably, the printing apparatus further includes at least one discharging element configured to discharge electric charges stored in a capacitive element in advance of outputs of the first detection signal and the second detection signal, wherein the capacitive element is used for the electric device of the at least one printing material container in the case where the electric device is a sensor for detecting whether a remaining amount of a printing material contained in the at least one printing material container is more than or equal to a predetermined amount.

If there exist electric charges stored in the capacitive element functioning as the sensor when detecting contacts and any short circuit between the sensor and the printing-apparatus side terminals, an electric current caused by the electric charges results in occurrence of measurement errors. That is, it is difficult to detect the presence or absence of any short circuit with reference to a predetermined electric potential (for example, a grounding potential). Therefore, in the aspect of the invention, it is possible to suppress degradation of accuracy in the short-circuit detection by providing the at least one discharging element, through which the electric charges stored in the capacitive element are caused to discharge in advance of the contact/short-circuit detections performed by the first and second detection unit, and further, causing the electric charges stored in the capacitive element to discharge through the at least one discharging element.

(6) In the aspect of the invention, the first detection terminal and the third detection terminal may be located adjacent to each other, and the second detection terminal and the fourth detection terminal may be located adjacent to each other.

In the case where the first detection terminal and the third detection terminal are located adjacent to each other, the both terminals are highly likely to short-circuit via, for example, electrically conductive ink, or the like. Further, in the case where the second detection terminal and the fourth detection terminal are located adjacent to each other, the both terminals are highly likely to short-circuit via, for example, electrically conductive ink, or the like. Therefore, it is important to implement the protection operation by means of the short-circuit detection.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a preferred embodiment according to the invention will be described in detail. In addition, the embodiment described below does not unreasonably limit the content of the invention set forth in the appended claims, and all components described in this embodiment are not essential to solutions provided by the invention.

Figure 1:
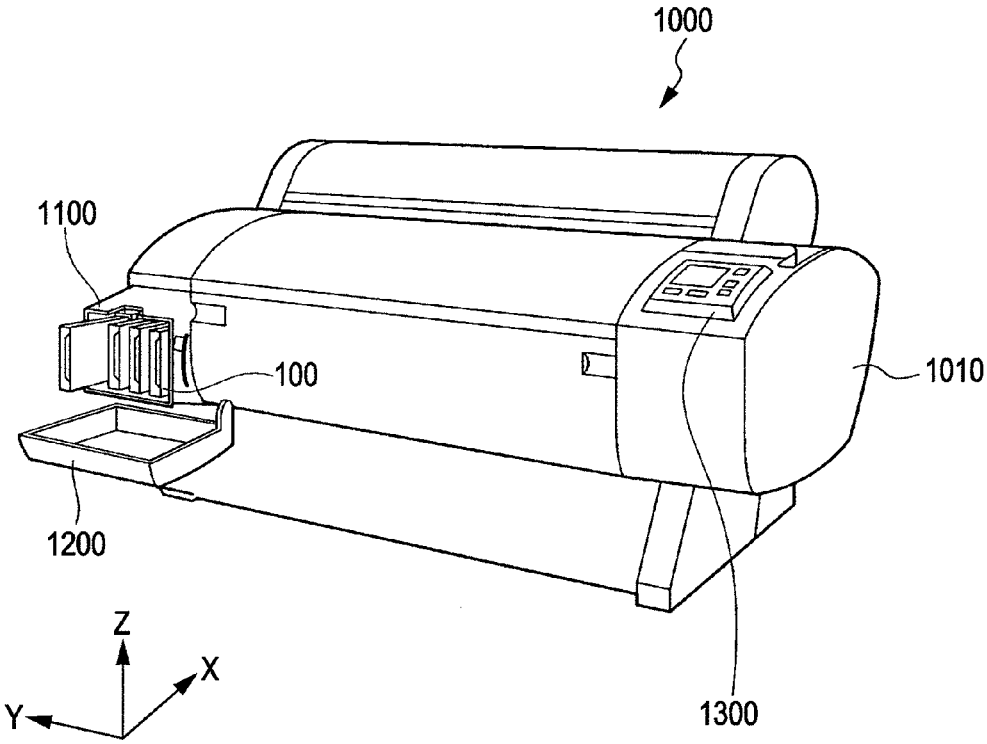
FIG. 1 is a perspective view illustrating a configuration of a printing apparatus according to an embodiment of the invention.

FIG. 1 is a perspective view illustrating a configuration of a printing apparatus according to an embodiment of the invention. A printing apparatus 1000 includes ink cartridges (printing material containers) 100 and an apparatus main body 1010, and the apparatus main body 1010 includes a cartridge attachment unit 1100, into which the cartridges 100 are attached, a rotatable cover 1200 and an operation unit 1300. The cartridge attachment unit 1100 is also referred to as "a cartridge holder", and further, is also referred to as just "a holder" or "an attachment unit".

In an example shown in FIG. 1, four ink cartridges are independently attachable into the cartridge attachment unit 1100, and, for example, four kinds of ink cartridges 100 for black, yellow, magenta and cyan colors are attached thereinto. The cover 1200 can be omitted. The operation unit 1300 is an input device through which users perform various instructions and settings, and includes a display unit for informing users of various notifications.

Figure 2B:
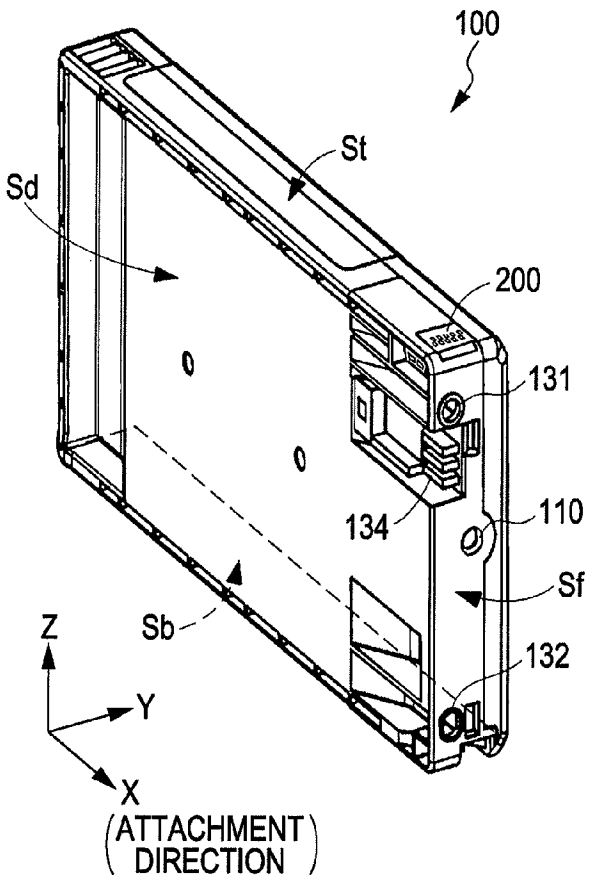
FIGS. 2A and 2B are perspective views each illustrating an external view of an ink cartridge according to an embodiment of the invention.
Figure 2A:
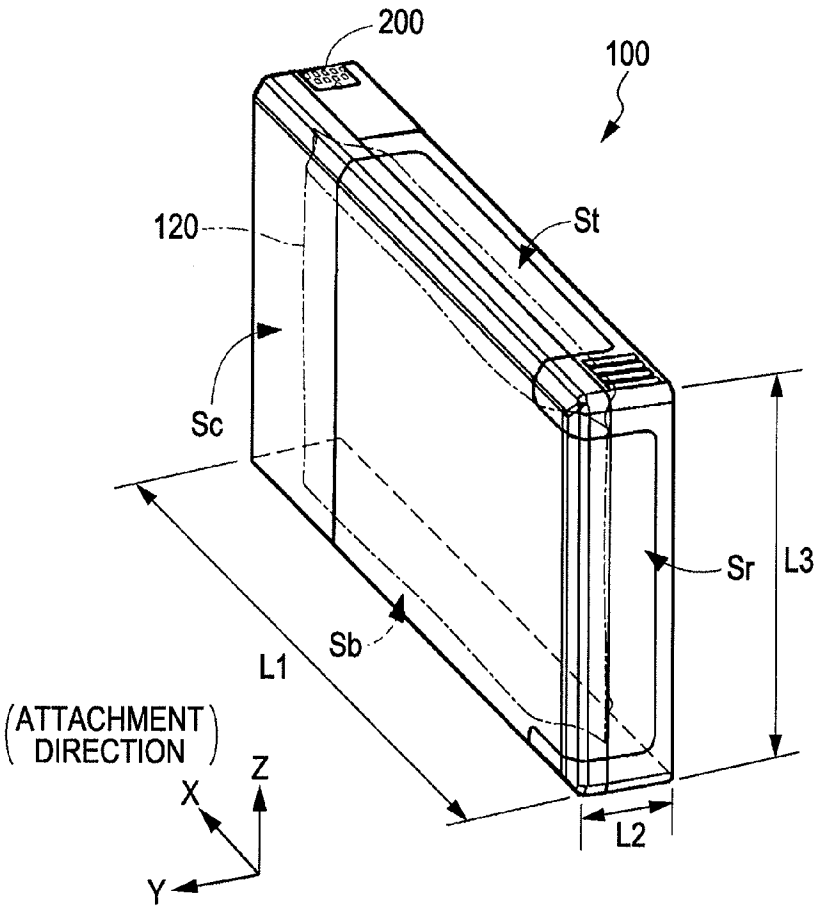

FIGS. 2A and 2B are perspective views each illustrating an external view of the ink cartridge 100. The X, Y and Z axes shown in FIGS. 2A and 2B correspond to the X, Y and Z axes shown in FIG. 1, respectively. In addition, the ink cartridge is also referred to as just "a cartridge". This cartridge 100 has a flattened and substantially rectangular-solid shaped external view, and among three directional dimensions L1, L2 and L3, the length L1 (an attachment-direction size of the cartridge 100) is the largest one, the width L2 is the smallest one, and the height L3 is an intermediate one between the length L1 and the width L2.

The cartridge 100 has an anterior edge surface (a first surface) Sf, a posterior edge surface (a second surface) Sr, a ceiling surface (a third surface) St, a bottom surface (a fourth surface) Sb, and two side surfaces (fifth and sixth surfaces) Sc and Sd. An ink containing chamber 120 (which is also referred to as "an ink containing bag") formed of a flexible material is provided inside the cartridge 100. The anterior edge surface Sf has two locating holes 131 and 132, and an ink feed opening 110 thereon. The ceiling surface St has a circuit substrate 200 thereon. On the circuit substrate 200, an involatile storage element for storing therein information related to ink is mounted. The first side surface Sc and the second side surface Sd are located opposite to each other, and further, each thereof is located orthogonal to the anterior edge surface Sf, the ceiling surface St, the posterior edge surface Sr and the bottom surface Sb. At a position where the second side surface Sd and the anterior edge surface Sf intersect with each other, a concavo-convex connection unit 134 is located.

Figure 3A:
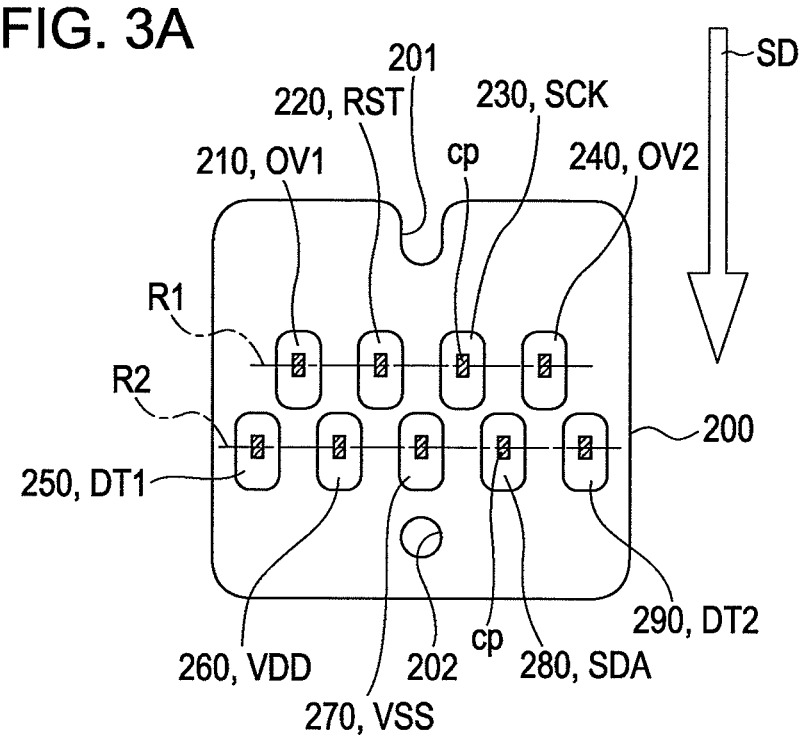
FIG. 3A is a diagram illustrating a configuration of the surface of a substrate according to an embodiment of the invention.
Figure 3B:
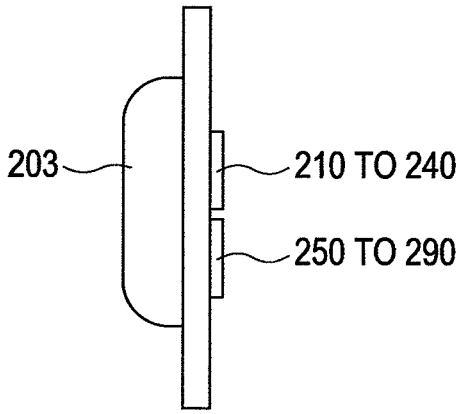
FIG. 3B is a diagram illustrating a configuration of a substrate when viewed from a lateral side thereof, according to an embodiment of the invention.

FIG. 3A is a diagram illustrating a configuration of the circuit substrate (hereinafter, which will be also referred to as just "a substrate") 200 according a first embodiment. The first surface of the substrate 200 is a surface which is exposed in the outward direction under the state where the substrate 200 is mounted on the cartridge 100. FIG. 3B shows a diagram when viewed from a lateral side of the substrate 200. At the upper edge portion of the substrate 200, a boss groove 201 is formed, and at the lower edge portion of the substrate 200, a boss hole 202 is formed.

An arrow SD of FIG. 3A indicates a direction in which the cartridge 100 is attached into the cartridge attachment unit 1100. This attachment direction SD corresponds to an attachment direction (i.e., the X-axis direction) of the cartridge 100, shown in each of FIGS. 2A and 2B. The substrate 200 has a storage device 203 mounted on the second surface thereof, and has a group of terminals, which consists of, for example, nine terminals 210 to 290, mounted on the first surface thereof. The storage device 203 stores therein pieces of information related to ink contained in the cartridge 100 (for example, a piece of information related to a remaining amount of ink). The terminals 210 to 290 are each formed in a substantially rectangular shape, and are disposed so as to form two rows along a direction substantially perpendicular to the attachment direction SD.

Here, out of the two rows, a row located at the near side in the attachment direction SD (a row located at the upper side of FIG. 3A) is referred to as an upper-side row R1 (a first row), and a row located at the back side in the attachment direction SD (a row located at the lower side of FIG. 3A) is referred to as a lower-side row R2 (a second row). In addition, these rows R1 and R2 can be also recognized as rows each being formed by contact portions cp of the plurality of terminals (the contact portions cp being portions at each of which one of the plurality of terminals and a corresponding one of a plurality of apparatus side terminals described below is contacted with each other).

The terminals 210 to 240 forming the upper side row R1 and the terminals 250 to 290 forming the lower side row R2 have the following functions (applications).

1. Upper-side Row R1

(1) An attachment detection terminal (a second terminal) 210
(2) A reset terminal 220
(3) A clock terminal 230
(4) An attachment detection terminal (a second terminal) 240

2. Lower-side Row R2

(5) An attachment detection terminal (a first terminal, a sensor terminal) 250
(6) A power supply terminal 260
(7) A ground terminal 270
(8) A data terminal 280
(9) An attachment detection terminal (a first terminal, a sensor terminal) 290

The four attachment detection terminals 210, 240, 250 and 290 are used for detecting whether electric contacts with corresponding apparatus main-body side terminals 510, 540, 550 and 590 (which will be described below with reference to FIG. 4) are under normal conditions or under abnormal conditions, and can be also referred to as "contact detection terminals". Further, attachment detection processing can be also referred to as "contact detection processing". In this embodiment, the four attachment detection terminals 210, 240, 250 and 290 can be also used for a short-circuit detection, besides the attachment detection. Further, the terminals 210 and 240 of the attachment detection terminals can be also used for an overvoltage detection. Therefore, the terminals denoted by symbols 250 and 290 are also referred to as "two first terminals", and the terminals denoted by symbols 210 and 240 are also referred to as "two second terminals". Further, out of the four attachment detection terminals 210, 240, 250 and 290, the terminals 250 and 290, which are connected to a sensor 208 described below, are also referred to as "sensor terminals". The other five terminals 220, 230, 260, 270 and 280 are terminals used for the storage device 203, and are also referred to as "memory terminals".

Each of the plurality of terminals 210 to 290 has the contact portion cp at the central portion thereof, which is to be contacted with a corresponding terminal of the plurality of apparatus main-body side terminals. Each of the contact portions cp of the terminals 210 to 240 forming the upper-side row R1 and each of the contact portions cp of the terminals 250 to 290 forming the lower-side row R2 are alternatively disposed, and form a so-called staggered formation. Further, each of the terminals 210 to 240 forming the upper-side row R1 and each of the terminals 250 to 290 forming the lower-side row R2 are also alternatively disposed so as to cause central lines thereof not to align in the attachment direction SD, and form a staggered formation.

The contact portions cp of the two attachment detection terminals 210 and 240 of the upper-side row R1 are disposed at both end portions of the upper-side row R1, that is, at the most outer sides of the upper-side row R1, respectively. Further, the contact portions cp of the two attachment detection terminals 250 and 290 of the lower-side row R2 are disposed at both end portions of the lower-side row R2, that is, at the most outer sides of the lower-side row R2, respectively. The contact portions cp of the memory terminals 220, 230, 260, 270 and 280 are disposed so as to gather at a substantially central portion of an area inside which the entire plurality of terminals 210 to 290 are disposed. Further, the contact portions cp of the four attachment detection terminals 210, 240, 250 and 290 are located so as to correspond to respective four corners of an aggregate of the memory terminals 220, 230, 260, 270 and 280.

Figure 4:
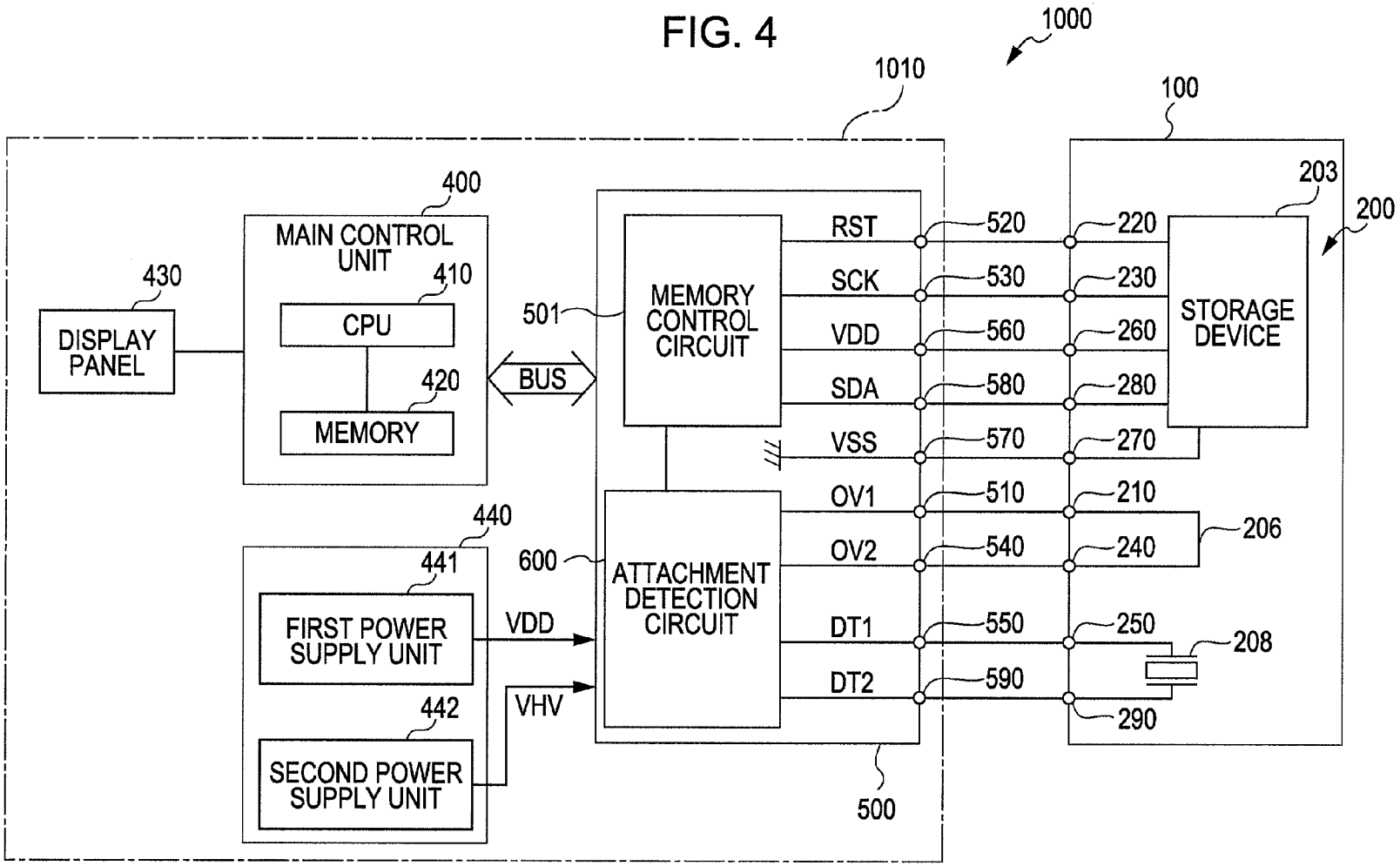
FIG. 4 is a block diagram illustrating an electric configuration of a substrate of an ink cartridge, and an apparatus main body, according to an embodiment of the invention.

FIG. 4 is a block diagram illustrating an electric configuration of the circuit substrate 200 of the cartridge 100, and the apparatus main body 1010, according to the first embodiment. The apparatus main body 1010 of the printing apparatus 1000 includes a display panel 430, a power supply circuit 440, a main control circuit 400, and a sub-control circuit 500. The display panel 430 is a display unit for informing users of various notifications, such as operation conditions of the printing apparatus 1000 and attachment conditions of the cartridges. The display panel 430 is provided on, for example, the operation unit 1300 shown in FIG. 1. The power supply circuit 440 includes a first power supply unit 441 for generating a first power supply voltage VDD and a second power supply unit 442 for generating a second power supply voltage VHV.

The first power supply voltage VDD is a general power supply voltage (rated 3.3 V) used for logic circuits. The second power supply voltage VHV is a high voltage (for example, rated 42 V) for driving a print head to eject inks. These voltages VDD and VHV are supplied to the sub-control circuit 500, and are also supplied to other circuits in accordance with necessity. The main control circuit 400 includes a CPU 410 and a memory 420. The sub-control circuit 500 includes a memory control circuit 501 for executing accesses to the storage device 203 of the cartridge, and an attachment detection circuit 600. In addition, a circuit including the main control circuit 400 and the sub-control circuit 500 can be also referred to as "a control circuit (a control unit)".

The apparatus main body 1010 of the printing apparatus 1000 is provided with a plurality of terminals 510 to 590 connected to the sub-control circuit 500. These apparatus main-body side terminals 510 to 590 are contacted with the plurality of terminals 210 to 290 of the printing material container (the ink cartridge) 100, respectively. Here, the terminals denoted by symbols 550 and 590 are referred to as a first detection terminal 550 and a second detection terminal 590, which are contacted with the cartridge side two first terminals 250 and 290, respectively. Further, the terminals denoted by the symbols 510 and 540 are referred to as a third detection terminal 510 and a fourth detection terminal 540, which are contacted with the cartridge side two second terminals 210 and 240, respectively.

The reset terminal 220, the clock terminal 230, the power supply terminal 260, the ground terminal 270 and the data terminal 280 of the nine terminals provided on the substrate 200 (FIG. 3) of the cartridge are electrically connected to the storage device 203. The storage device 203 is a nonvolatile memory, for which any address terminals are not provided, memory cells to be accessed are determined on the basis of the number of pulses of the clock signal SCK input from the clock terminal 230 and command data input from the data terminal 280, and data is transmitted and received through the data terminal 280 in synchronization with the clock signal SCK. The clock terminal 230 is used for supplying the clock signal SCK to the storage device 203 from the sub-control circuit 500 via the apparatus side terminal 530. The power supply terminal 260 and the ground terminal 270 are supplied with a power supply voltage (for example, 3.3V) and a ground voltage (0V) via the apparatus side terminals 560 and 570, respectively, the power supply voltage and the ground voltage being used for driving the storage device 203 from the printing apparatus 1000. This power supply voltage for driving the storage device 203 may be a voltage which is directly supplied from the first power supply voltage VDD, or may be a voltage which is generated from the first power supply voltage VDD, and which has a voltage level lower than that of the first power supply voltage VDD. The data terminal 280 is used for communication of a data signal SDA between the sub-control circuit 500 and the storage device 203 via the apparatus side terminal 580. The reset terminal 220 is used for supplying a reset signal RST to the storage device 203 from the sub-control circuit 500 via the apparatus side terminal 520. The two attachment detection terminals (the two second terminals) 210 and 240 are connected to each other via a wiring 206 inside the substrate 200 (FIG. 3) of the cartridge 100. Therefore, when the third and fourth detection terminals 510 and 540 are contacted with the two second terminals 210 and 240, respectively, the third and fourth detection terminals 510 and 540 are connected to each other via the wiring 206. The other attachment detection terminals (the two first terminals) 250 and 290 are connected to an electric device, such as the sensor 208, provided inside the cartridge 100. The cartridge side two first terminals 250 and 290 also function as sensor terminals, and are contacted with the apparatus side first and second detection terminals 550 and 590, respectively.

Here, in order to allow the sensor 208 to detect the remaining amount of ink, a liquid amount inspection signal is supplied to one of electrodes of a piezoelectric element forming the sensor 208 via the sensor terminal 290. The liquid amount inspection signal is an analog signal which is generated by a high-voltage generation unit 661 (refer to FIGS. 5 to 7), and which has a maximum voltage level of, for example, approximately 36 V. The sensor 208 vibrates in accordance with the remaining amount of ink contained in the cartridge 100, and a back electromotive voltage, which has arisen because of the vibration, is transmitted as a liquid amount response signal RS to a liquid amount detection unit 664 (refer to FIG. 5) from the piezoelectric element via the other sensor terminal 250. The liquid amount response signal RS has vibration components including a frequency corresponding to the number of vibrations of the piezoelectric element. The liquid amount detection unit 664 can detect whether the remaining amount of ink is more than or equal to a predetermined amount, or not, by measuring the frequency of the liquid amount response signal RS. This ink remaining amount detection processing is high-voltage processing for supplying a high-voltage signal having a voltage level higher than that of a first attachment detection signal SPins, which is used in an attachment detection (a contact detection) described below, to the sensor 208 via the terminal 250.

Figure 5:
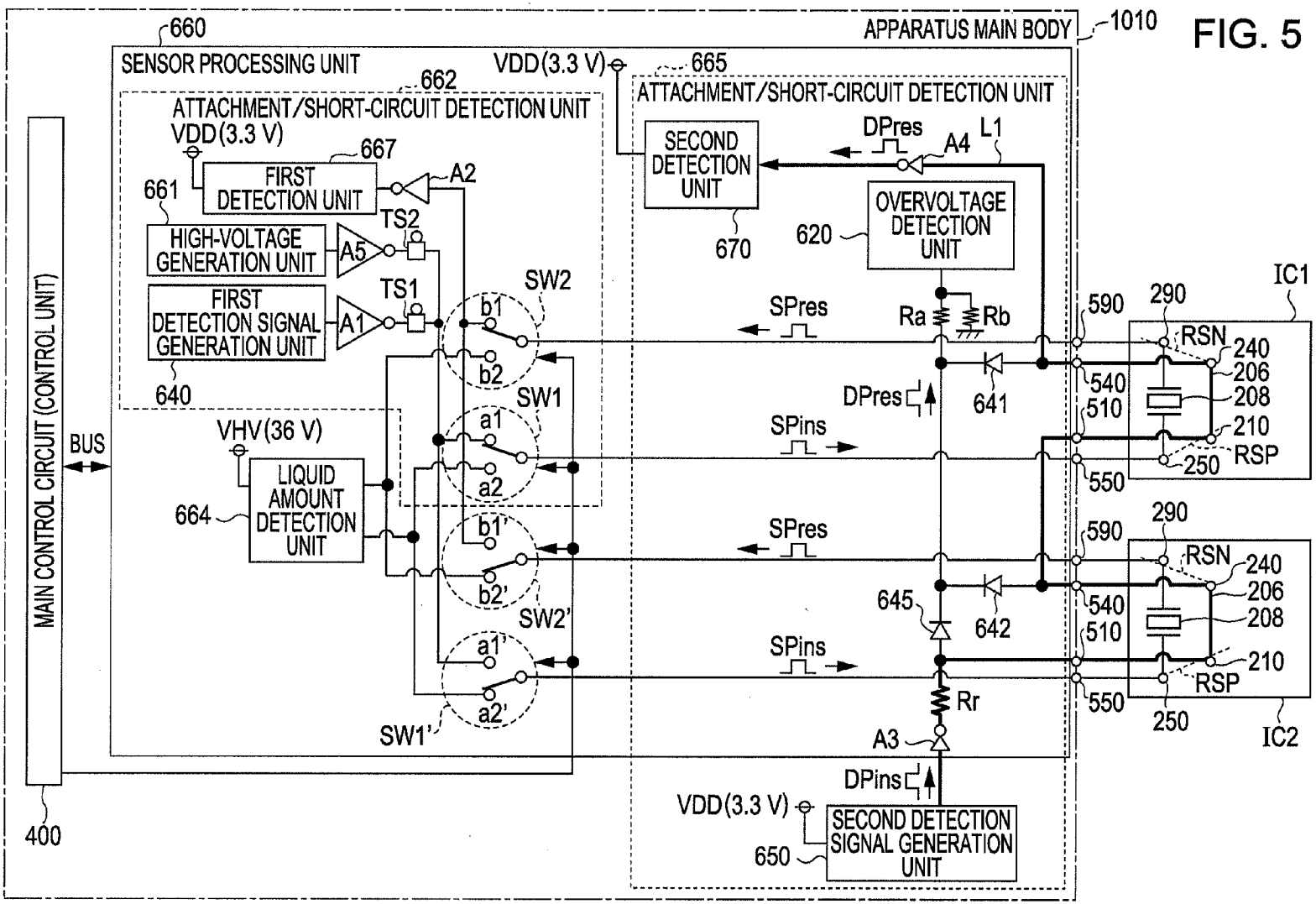
FIG. 5 is a block diagram illustrating a specific example of an electric configuration of substrates of ink cartridges, and an apparatus main body, according to an embodiment of the invention.

FIG. 5 is a block diagram illustrating a specific example of an electric configuration of the circuit substrates 200 of the cartridges 100, and the apparatus main body 1010, according to the first embodiment. In addition, in FIG. 5, only two ones of the four-color ink cartridges 100 shown in FIG. 1 are illustrated.

The printing apparatus 1000 includes at least one printing material container (at least one ink cartridge or the like), which contains a printing material (an ink or the like), and is attachable to the printing apparatus 1000. The printing apparatus 1000 shown in FIG. 5 executes printing, being supplied with printing materials (inks or the like) from printing material containers (ink cartridges) IC1 and IC2.

In this printing apparatus 1000, a sensor processing unit 660 includes two attachment/short-circuit detection units 662 and 665. The two attachment/short-circuit detection units 662 and 665 are used for detecting whether the printing material containers (the ink cartridges) IC1 and IC2 are normally attached to the printing apparatus 1000, or not, and whether at least one of two kinds of unintended abnormal short circuits exists, or not, a first one being a short circuit occurring between the first detection terminal 550 and the fourth detection terminal 540, which are originally not to be connected to each other, a second one being a short circuit occurring between the second detection terminal 590 and the third detection terminal 510, which are also originally not to be connected to each other.

In addition, short circuits to be detected here are ones which occur when the sensor processing unit (a sensor driving circuit) 660 applies the high voltage to the sensor 208, and which include all short circuits resulting in an electric conduction between the third detection terminal 510, from which a second attachment detection signal (a second detection signal) DPins shown in FIG. 5 is output, and the second detection terminal 590, to which a first detection unit 667 is connected, and another electric conduction between the first detection terminal 550, from which the first attachment detection signal (a first detection signal) SPins is output, and the fourth detection terminal 540, to which a second detection unit 670 is connected. Such short circuits are unintended ones which occur because of, for example, adherence of ink. In other words, short circuits to be detected are ones which result in a situation in which the high voltage, which is to be applied to the sensor terminals 250, 290, 550 and 590 by the sensor processing unit (sensor driving circuit) 660, is applied to any of the terminals other than the sensor terminals 250, 290, 550 and 590, and the storage device 203 and the sub-control circuit 500 are each supplied with a voltage having a voltage level exceeding an absolute maximum rating therefor.

In addition, in the sensor processing unit 660 shown in FIG. 5, the two attachment/short-circuit detection units 662 and 665 correspond to the attachment detection circuit 600 shown in FIG. 4.

(1) Attachment Detection (Contact Detection)

The attachment/short-circuit detection unit 662 includes a first detection signal generation unit 640 and the first detection unit 667, and further, the attachment/short-circuit detection circuit 665 includes a second detection signal generation unit 650 and the second detection unit 670.

The first detection signal generation unit 640 generates the first detection signal SPins. The first detection signal SPins, which is generated by the first detection signal generation unit 640, flows through a path, which will be described below in detail, and is detected by the first detection unit 667 if the first and second detection terminals 550 and 590 are contacted with the two first terminals 250 and 290 of the ink cartridge IC1, respectively. That is, the first detection signal SPins, which is generated by the first detection signal generation unit 640, flows through a path (i.e., a first attachment detection path), and is detected as a first detection response signal SPres by the first detection unit 667, the first attachment detection path including elements shown in FIG. 5, which are an output buffer A1, a switch TS1, switch SW1 (a contact point a1), the first detection terminal 550, the ink cartridge IC1 (the first terminal 250, the sensor 208 and the first terminal 290), the second detection terminal 590, a switch SW2 (a contact point b1), and an input buffer A2.

Here, in the case where the sensor 208, which is an example of the electric device, is a capacitive element, a voltage having been applied to one of the both terminals of the sensor 208 causes a voltage to occur at the other one of the both terminals of the sensor 208 because of a capacitive coupling. As described above, since the voltage of the first detection signal SPins transmits via the sensor 208, the first detection response signal SPres based on the first detection signal Spins can be detected by the first detection unit 667.

If the first and second detection terminals 550 and 590 are not contacted with the two first terminals 250 and 290 of the ink cartridge IC1, respectively, the first attachment detection path does not come to existence. In this case, the first detection response signal SPres based on the first detection signal SPins is never detected by the first detection unit 667. In this way, the first detection unit 667 can highly accurately detect the contacts or non-contacts of the first and second detection terminals 550 and 590 with the respective two first terminals 250 and 290 by determining whether the first detection response signal SPres based on the first detection signal SPins has been successfully detected, or not.

Moreover, an inspection with respect to another ink cartridge IC2 can be performed merely by using a switch SW1' (a contact point a1') and a switch SW2' (a contact point b1') in place of the switches SW1 and SW2 described above. In this way, it is possible to perform inspections with respect to the plurality of ink cartridges IC1 and IC2 on a time division basis.

The second detection signal generation unit 650 generates the second detection signal DPins. The second detection signal DPins, which is generated by the second detection signal generation unit 650, flows through a path, which will be described below in detail, and is detected by the second detection unit 670 if the third and fourth detection terminals 510 and 540, which are provided for each of the ink cartridges IC, are contacted with the respective two first terminals 210 and 240 of each of the ink cartridges IC. That is, the second detection signal DPins, which is generated by the second detection signal generation unit 650, flows through a path (i.e., a second attachment detection path), and is detected as a second detection response signal DPres by the second detection unit 670, the second attachment detection path including an output buffer A3; a resistor Rr; the third detection terminal 510, an ink cartridge detection path (i.e., the second terminal 210, the wiring 206 and the second terminal 240) and the fourth detection terminal 540 for each of the ink cartridges IC; and an input buffer A4.

If the third and fourth detection terminals 510 and 540 are not normally contacted with the two first terminals 210 and 240, respectively, for any of the ink cartridges IC, the second attachment detection path described above does not come to existence. In this case, the second detection response signal DPres based on the second detection signal DPins is never detected by the second detection unit 670. In this way, the second detection unit 670 can highly accurately detect the contacts or non-contacts of the third and fourth detection terminals 510 and 540 with the respective two second terminals 210 and 240 for each of the cartridges IC by determining whether the second detection response signal DPres based on the second detection signal DPins has been successfully detected, or not.

(2) Short-Circuit Detection

In this embodiment, the presence or absence of any short circuit occurring between terminals, which is likely to cause at least one of the foregoing storage device and the control circuits to be supplied with a voltage having a voltage level exceeding an absolute maximum rating therefor, is also detected by using the foregoing first and second detection signal generation units 640 and 650, as well as the foregoing first and second detection units 667 and 670. That is, the contact detection and the short-circuit detection are simultaneously carried out. The outline of this short-circuit detection will be described with reference to FIGS. 6 and 7. In addition, in each of FIGS. 6 and 7, for the sake of convenience of drawing, there is shown only one of the cartridges 100.

Figure 6:
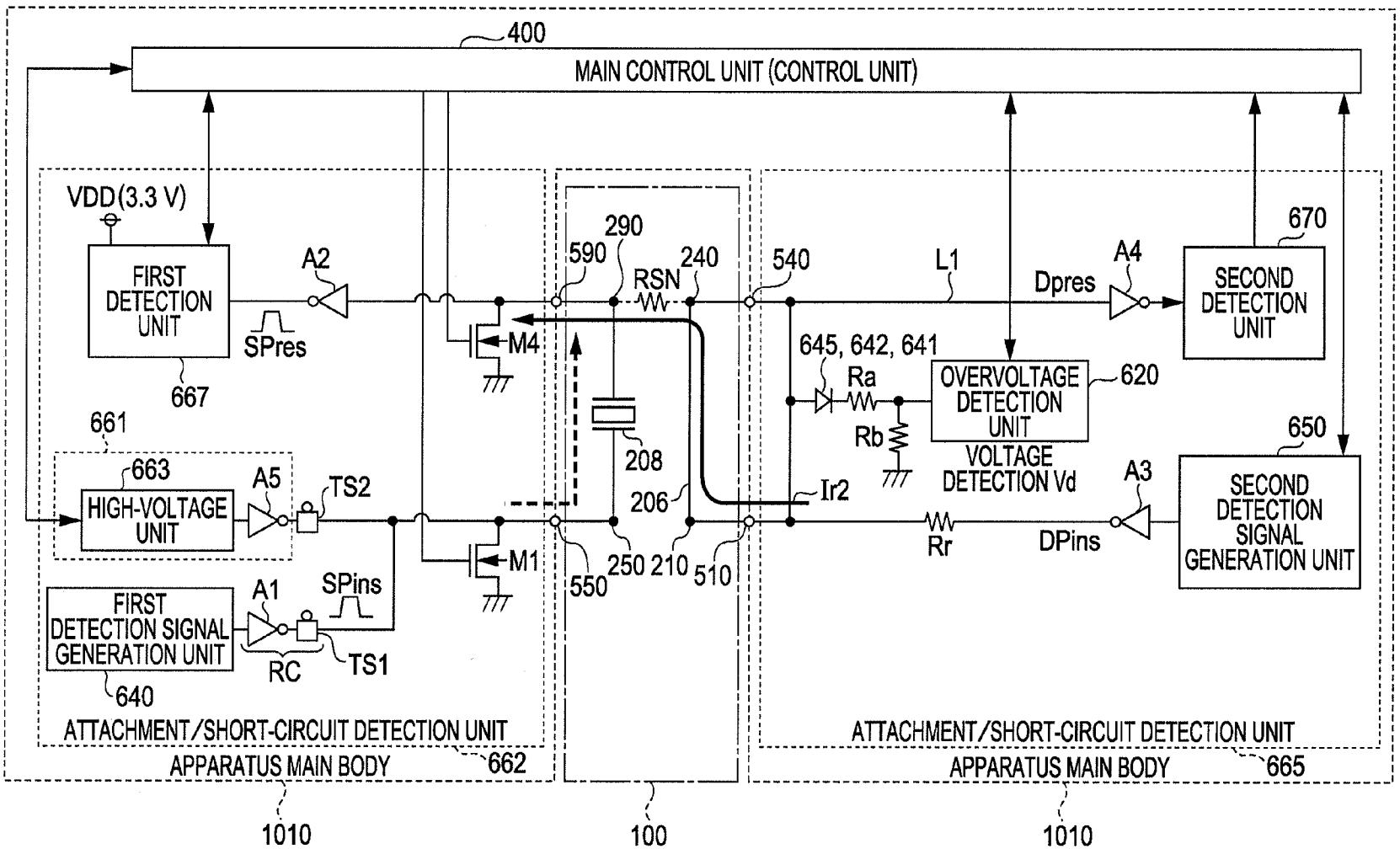
FIG. 6 is a diagram illustrating short-circuit detection operations under the state where a short circuit between terminals occurs via a short-circuit resistance RSN, according to an embodiment of the invention.

FIG. 6 is a diagram illustrating operations under the state where a short circuit occurs between the second detection terminal 590 and the third detection terminal 510. In addition, the short circuit between the second detection terminal 590 and the third detection terminal 510 may be understood as any short circuit which results in the short circuit therebetween, and thus, includes a short circuit between the cartridge side terminals 240 and 290, a short circuit between the apparatus main-body side second and fourth detection terminals 590 and 540, and the like.

In this case, the first detection unit 667 receives a signal resulting from synthesizing the first detection signal SPins flowing through the first attachment detection path described above, and the second detection signal DPins flowing through a first short-circuit path Ir2 which particularly includes a first short-circuit portion (a short-circuit resistance RSN) between the second detection terminal 590 and the fourth detection terminal 540 (the third detection terminal 510), and which includes the resistor Rr, the third detection terminal 510, the cartridge side elements (i.e., the second terminal 210, the wiring 206 and the second terminal 240), the short-circuit resistance RSN and the second detection terminal 590. Further, the first detection unit 667 detects the short circuit between the second detection terminal 590 and the third detection terminal 510 on the basis of the received signal.

Figure 7:
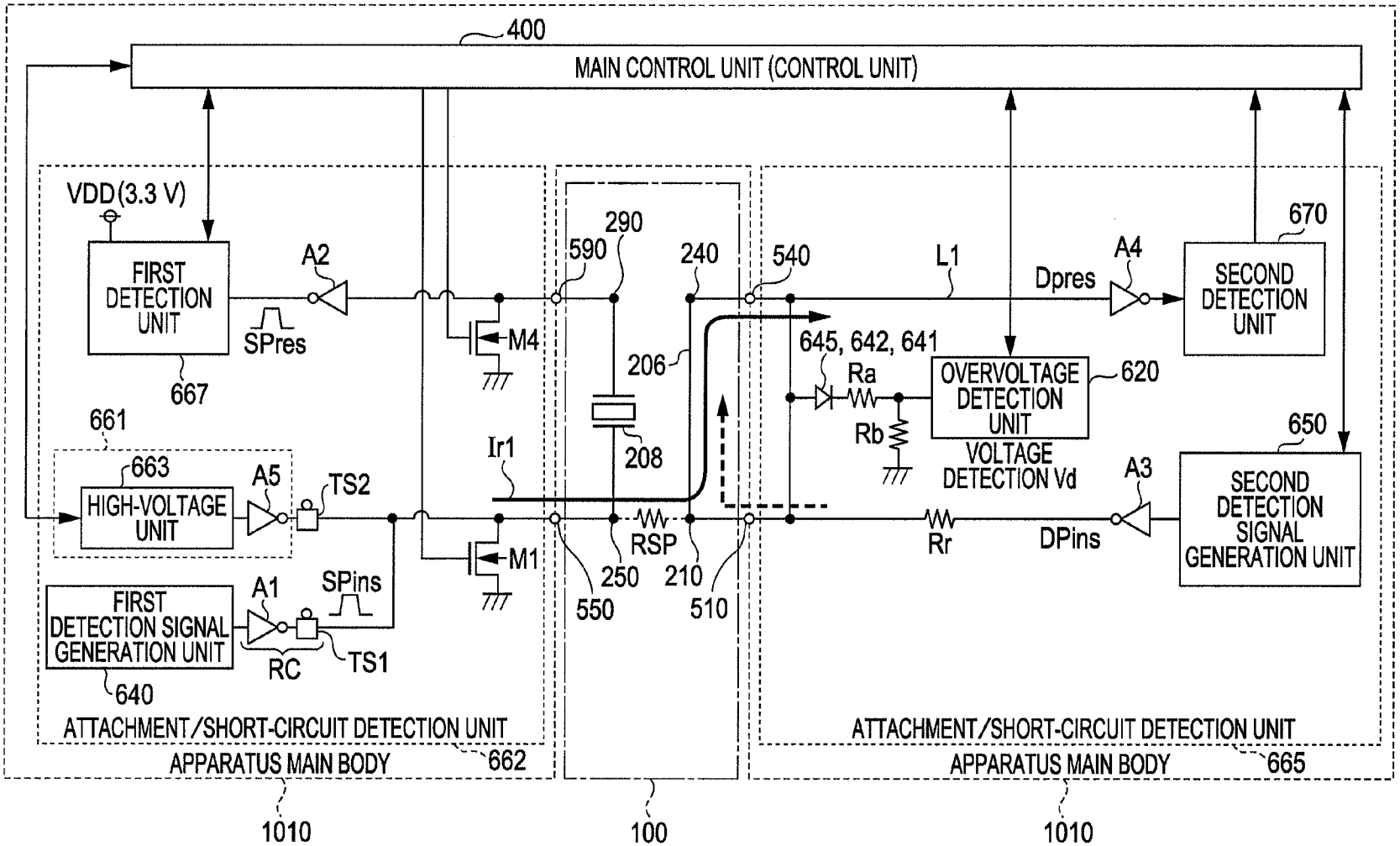
FIG. 7 is a diagram illustrating short-circuit detection operations under the state where a short circuit between terminals occurs via a short-circuit resistance RSP, according to an embodiment of the invention.

FIG. 7 is a diagram illustrating operations under the state where a short circuit occurs between the first detection terminal 550 and the fourth detection terminal 540. In addition, the short circuit between the first detection terminal 550 and the fourth detection terminal 540 may be understood as any short circuit which results in the short circuit therebetween, and thus, includes a short circuit between the cartridge side terminals 210 and 250, a short circuit between the apparatus main-body side first and third detection terminals 550 and 510, and the like.

In this case, the second detection unit 670 receives a signal resulting from synthesizing the second detection signal DPins flowing through the second attachment detection path described above, and the first detection signal SPins flowing through a second short-circuit path In which particularly includes a second short-circuit portion (a short-circuit resistance RSP) between the first detection terminal 550 and the third detection terminal 510 (the fourth detection terminal 540), and which includes a resistance Rc, the first detection terminal 550, the short-circuit resistance RSP, the cartridge side elements (i.e., the second terminal 210, the wiring 206 and the second terminal 240) and the fourth detection terminal 540. Further, the second detection unit 670 detects the short circuit between the first detection terminal 550 and the third detection terminal 510 on the basis of the received signal.

According to this configuration, both of the two kinds of attachment detection signals SPins and DPins are also used for the short-circuit detection, and any short circuit occurring between terminals can be detected by causing the first detection unit 667 to detect a signal based on the attachment detection signal DPins, and causing the second detection unit 670 to detect a signal based on the attachment detection signal SPins. These signals can be detected on a digital processing basis. Further, the two kinds of short-circuit detection signals SPins and DPins can be realized as, for example, pulse signals. Therefore, any analog circuit of high accuracy is not needed.

The contact detection and the short-circuit detection are usually carried out prior to detection of remaining amounts of inks during a process the printing apparatus 1000 performs upon turning on of the power supply thereof, or upon replacement of any of the ink cartridges thereof. Therefore, if any short circuit is detected with respect to a certain one of the cartridges 100 during the contact detection for detecting whether the individual cartridges 100 are correctly attached to the holder 1100, or not, it is preferable to cause the printing apparatus 1000 not to perform the detection of remaining amounts of inks, but to output a message for recommending users to replace the corresponding cartridges 100, or advising users to remove stains of the corresponding cartridges 100.

(3) Overvoltage Detection

Next, an outline of detection of an overvoltage situation due to the short circuit described above will be described. This overvoltage detection is processing for preventing occurrence of a situation in which, during the detection of remaining amounts of inks, the high voltage for driving sensors is applied to the main control circuit 400, the sub-control circuit 500 and/or the storage device 203, because of, for example, any short circuit which has not been detected during the attachment detection, but arises during the detection of remaining amounts of inks. As shown in FIGS. 5 to 7, it is possible to provide the high-voltage generation unit 661 in the attachment/short-circuit detection unit 662, and provide an overvoltage detection unit 620 in the attachment/short-circuit detection unit 665.

The high-voltage generation unit 661 can generate a high voltage having a voltage level (for example, 36V to 42V) higher than the voltage level (for example, 3.3V) of each of the voltages of the first and second detection signals SPins and DPins. The high-voltage generation unit 661 (including a high-voltage unit 663 and an output buffer A5) applies a high voltage having a voltage level (for example, 42V) to the sensor 208 via the switch TS2, and the liquid amount detection unit 664 shown in FIG. 5 detects the remaining amounts of inks contained in the respective ink cartridges IC1 and IC2.

In the case where at least one of a short circuit via the short-circuit resistance RSN (FIG. 6) and a short circuit via the short-circuit resistance RSP (FIG. 7) occurs when the high voltage is applied, the high voltage is voltage-divided by voltage division resistors Ra and Rb, and can be detected by the overvoltage detection unit 620 via at least one of two paths, one being a path including the short-circuit resistance RSN (FIG. 6) and the fourth detection terminal, the other one being a path including the short-circuit resistance RSP (FIG. 7) and the third detection terminal 510, and at least one of diodes 641, 642 and 645 shown in FIG. 5.

When any short circuit occurs between at least one of the sensor terminals 250, 290, 550 and 590, and at least one of the terminals 210, 240, 510 and 540 other than the sensor terminals, and further, a voltage having a voltage level higher than a predetermined voltage level is applied to the at least one of the terminals 210, 240, 510 and 540 other than the sensor terminals, this occurrence of the overvoltage situation is detected by the overvoltage detection unit 620. In this case, for example, a protection operation, in which, upon reception of the detection result, the main control circuit (the control unit) 400 lowers or shuts off the high voltage, can be promptly carried out. Consequently, a preferable overvoltage protection operation can be carried out independently of the short-circuit detection between terminals.

(4) Detailed Description of Short-Circuit Detection

It has already been described that, in the case where a short circuit shown in FIG. 6 occurs, the first detection unit 667 detects the short circuit occurring between the second detection terminal 590 and the third detection terminal 510 by detecting the second detection signal DPins flowing through the first short-circuit path (Ir2) including the short-circuit resistance RSN, in preference to the first detection signal SPins flowing through the first attachment detection path. This means that the electric-current driving capability of the second detection signal DPins flowing through the first short-circuit path (Ir2) is set so as to enable the first detection unit 667 to detect the second detection signal DPins under the state where any short circuit having such a resistance value that causes any failure occurs. Under the condition where the electric-current driving capability of the first detection signal generation unit 640 itself is substantially equal to that of the second detection signal generation unit 650 itself, it depends on a difference between the impedances of the first attachment detection path and the first short-circuit path, the impedances being ones when seen from the first detection unit 667, whether the second detection signal DPins can be detected by the first detection unit 667, or not. That is, it is conditioned that the impedance of the first attachment detection path is larger than the impedance of the first short-circuit path.

Here, regarding the impedance of the first attachment detection path, the impedance Rc of the output buffer A1 and the switch TS1, as well as the impedance of the sensor 208 (referred to as Rz), is dominant. Particularly, in the case where the sensor 208 is a capacitive element, the impedance Rz of the sensor 208 is infinitive. Therefore, the condition, in which the impedance of the first attachment detection path is to be larger than the impedance of the first short-circuit path, is satisfied. Accordingly, the first detection unit 667 can detect the second detection signal DPins flowing through the first short-circuit path Ir2, shown in FIG. 6, including the short-circuit resistance RSN.

In the case where a short circuit shown in FIG. 7 occurs, similarly, it is conditioned that the impedance of the second attachment detection path is larger than the impedance of the second short-circuit path, the impedances being ones when seen from the second detection unit 670. In this case, the impedance of the second attachment detection path needs to be larger than the sum of the impedance Rc of the output buffer A1 and the switch TS1, which is dominant in the second short-circuit path, and the short-circuit resistance RSP.

In order to satisfy this condition, preferably, the printing apparatus 1000 shown in FIG. 5 is provided therein with an electric-current limitation resistor Rr for limiting an amount of electric current of the second detection signal DPins which is output from the third detection terminal 510.

The electric-current limitation resistor Rr can be set to a resistance value which satisfies the relation: Rr>Rc+RSP.

As described above, by utilizing the relatively large resistor Rz of the sensor 208 in the case where a short circuit shown in FIG. 6 exists, and utilizing the electric-current limitation resistor Rr in the case where a short circuit shown in FIG. 7 exists, it is possible to appropriately set the impedances of the first and second attachment detection paths and the impedances of the first and second short-circuit paths; whereby it is possible to appropriately adjust the electric-current driving capabilities of the first and second detection signals SPins and DPins. In this way, under the state where any short circuit occurs, the first detection signal SPins and the second detection signal DPins can be detected as the short-circuit detection signals by the second detection unit 670 and the first detection unit 667, respectively.

Moreover, when any short circuit has occurred between at least one of the apparatus main-body side terminals 510 and 540, and at least one of the apparatus main-body side sensor terminals 550 and 590 and the cartridge side sensor terminals 250 and 290, a resistance value of the short circuit, which causes the short circuit to be detected by means of the overvoltage detection/the short-circuit detection so that any failures do not occur inside the main control circuit 400, the sub-control unit 500 and/or the storage device 203, will be described below. Regarding the printing apparatus 1000 shown in FIG. 5, when a maximum voltage level of the foregoing high voltage is referred to as Vmax; a voltage, which results in being applied to the third detection terminal 510 or the fourth detection terminal 540 because of a short circuit while the sensor processing unit (sensor driving circuit) 660 is applying the high voltage to the sensor 208, is referred to as Vlim; and an electric current, which flows through the third detection terminal 510 or the fourth detection terminal 540 to which the voltage Vlim is applied, is referred to as Ilim, a value of each of the short-circuit resistances RSN and RSP to be detected by means of the overvoltage detection/the short-circuit detection is preferably smaller than a resistance value R', which is obtained by dividing the voltage level of the maximum voltage Vmax of the high voltage by the amount of the electric current Ilim, which is to be detected (i.e., R'=Vmax/Ilim).

That is, the following relation is preferably to be satisfied: RSN<Vmax/Ilim, RSP<Vmax/Ilim (provided that Vmax>>Vlim). This term "Vmax/Ilim" is a condition which causes each of devices targeted for protection (i.e., the control circuits and the storage device) not to suffer from any damage due to an overvoltage exceeding an absolute maximum rating therefor. Further, the term "Vmax/Ilim" is a boundary condition, below which the short-circuit detection/the overvoltage detection needs to operate effectively.

Moreover, in the printing apparatus 1000 shown in FIG. 5, in order to discharge electric charges stored in the sensors 208 of the respective printing material containers (the ink cartridges) IC1 and IC2 in advance of the various detections, discharging elements M1 and M4 (refer to FIG. 6 or FIG. 7) can be provided.

As described above, the printing apparatus 1000 provides two kinds of detection signals, i.e., the first and second detection signals, and upon occurrence of any short circuit between terminals, the printing apparatus 1000 detects mutual interferences of the two kinds of detection signals on a digital processing basis, and then, detects the presence or absence of the short circuit with reference to a predetermined electric potential (for example, a grounding potential).

Here, when detecting the short circuit, if electric charges are stored in the capacitive element functioning as the sensor 208, an electric current arising due to the electric charges causes measurement errors. That is, the electric charges stored in the sensor (the capacitive element) 208 make it difficult to detect the presence or absence of the short circuit with reference to a predetermined electric potential (for example, a grounding potential). Therefore, it is possible to provide discharging paths which enable the electric charges stored in the sensor (the capacitive element) 208 to be discharged therethrough in advance of performing the short-circuit detection. In this embodiment, by providing discharging paths which are formed while discharging elements (MOS transistors) M1 and M4 shown in FIGS. 6 and 7 are turned on, the electric charges stored in the sensor (the capacitive element) 208 are discharged through the discharging paths. In this way, the amount of electric charges stored in the sensor 208 is made zero, and afterword, the short-circuit detection is performed; thereby enabling suppression of degradation of accuracy in the short-circuit detection.

Further, in the printing apparatus 1000 shown in FIG. 5, in accordance with locations of the cartridge side terminals 210, 240, 250 and 290 shown in FIG. 3A, the apparatus main-body side first and third detection terminals 550 and 510 are located adjacent to each other, and the apparatus main-body side second and fourth detection terminal 590 and 540 are located adjacent to each other.

In the case where the first and third detection terminals 550 and 510 are located adjacent to each other, this situation increases the possibility that, because of, for example, electrically conductive inks, or the like, the both terminals short-circuit, thereby causing an overvoltage situation. Further, in the case where the second and fourth detection terminals 590 and 540 are located adjacent to each other, this situation increases the possibility that, because of, for example, electrically conductive inks or the like, the both terminals short-circuit, thereby causing an overvoltage situation. Therefore, it is important to implement the protection operation by means of the short-circuit detection. In the case where the first detection terminal 550 and the fourth detection terminal 540 are located adjacent to each other, and/or the second detection terminal 590 and the third detection terminal 510 are located adjacent to each other, similarly, this situation increases the possibility of causing an overvoltage state, and thus, in this case, it is also necessary to implement an overvoltage protection operation just like that described above.

The main control circuit (the control unit) 400 included in the printing apparatus 1000 shown in FIG. 5 performs control of the various inspections described above before the printing apparatus 1000 performs printing operations. Further, upon detection of any short circuit or any overvoltage, the control unit (the main control circuit) 400 can lower or shut off the voltage output from the high-voltage generation unit 661.

According to such a control method employed by the printing apparatus 1000, it is possible to increase safety margin with respect to the high-voltage driving operation performed by the printing apparatus 1000. In addition, in FIG. 5, elements denoted by reference symbols TS1 to TS3, and switches SW1, SW2, SW1' and SW2' are analog switches, and turning on/off operations thereof are controlled by the main control circuit (the control unit) 400.

Figure 8:
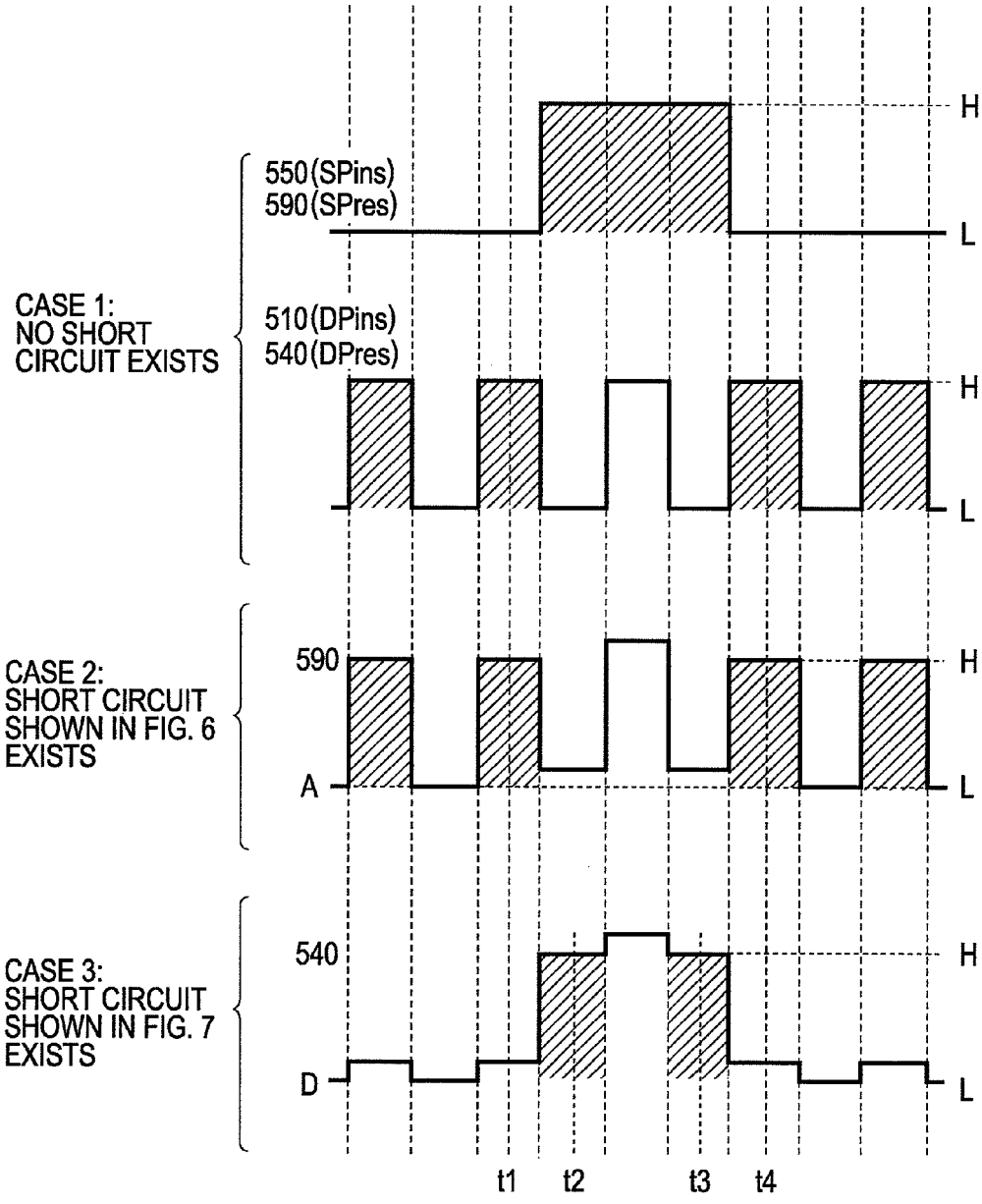
FIG. 8 is a diagram illustrating voltage waveforms of first to fourth detection terminals in each of three cases, a first one being a case where no short circuit exists, a second one being a case where a short circuit shown in FIG. 6 exists, a third one being a case where a short circuit shown in FIG. 7 exists, according to an embodiment of the invention.

Next, an example of individual waveforms regarding the attachment detection and the short-circuit detection will be described with reference to FIG. 8. FIG. 8 is a diagram illustrating voltage waveforms of the first to fourth detection terminals 510, 540, 550 and 590.

In the case where any short circuits do not exist, as shown in FIG. 8, the first detection signal SPins output from the first detection terminal 550 reaches the second detection terminal 590 as the first response signal SPres which substantially reflects the voltage waveform of the first detection signal SPins. Further, the second detection signal DPins output from the third detection terminal 510 reaches the fourth detection terminal 540 as the second response signal DPres which substantially reflects the voltage waveform of the second detection signal DPins.

In the case of FIG. 6 in which a short circuit due to the short-circuit resistance RSN occurs, the second response signal DPres based on the second detection signal DPins appears at the second detection terminal 590, which is connected to the first detection unit 667, because of the short circuit. That is, the second detection signal DPins flowing through the short-circuit resistance RSN (the first short-circuit path), the resistance value of which is smaller than that of the resistance Rz of the sensor 208 shown in FIG. 6, is more dominant than the first detection signal SPins flowing through the resistance Rz having a relatively large resistance value. In addition, in the case where a short circuit shown in FIG. 6 exists, the first response signal SPres based on the first detection signal SPins appears at the second terminal 590 shown in FIG. 8 after having been attenuated by the resistance Rz of the sensor 208, having a relatively large resistance value. Therefore, during periods each being denoted by a hatching in a portion of FIG. 8, which indicates the case where a short circuit shown in FIG. 6 exists, the voltage waveform of not the first response signal SPres but the second response signal DPres dominantly appears at the second detection terminal 590. In this case, the first detection unit 667 can detect the short circuit shown in FIG. 6 as a high level H at each of timings t1 and t4 shown in FIG. 8, or can detect the short circuit shown in FIG. 6 as a low level L at each of timings t2 and t3 shown in FIG. 8.

Meanwhile, in the case of FIG. 7 in which a short circuit due to the short-circuit resistance RSP occurs, the first response signal SPres based on the first detection signal SPins appears at the fourth detection terminal 540, which is connected to the second detection unit 670, because of the short circuit. That is, the first detection signal SPins flowing through the short-circuit resistance RSP (the second short-circuit path), the resistance value of which is smaller than that of the resistor Rr shown in FIG. 7, is more dominant than the second detection signal DPins flowing through the resistor Rr having a relatively large resistance value. In addition, in the case where a short circuit shown in FIG. 7 exists, the second response signal DPres based on the second detection signal DPins appears at the fourth detection terminal 540 shown in FIG. 8 after having been attenuated by the resistor Rr having a relatively large resistance value. Therefore, during periods each being denoted by a hatching in a portion of FIG. 8, which indicates the case where a short circuit shown in FIG. 7 exists, the voltage waveform of not the second response signal DPres but the first response signal SPres dominantly appears at the fourth detection terminal 540. In this case, the second detection unit 670 can detect the short circuit shown in FIG. 7 as a high level H at each of timings t2 and t3 shown in FIG. 8, or can detect the short circuit shown in FIG. 7 as a low level L at each of timings t1 and t4 shown in FIG. 8.

Furthermore, according to this embodiment, as described above, the contact detection and the short-circuit detection can be simultaneously performed. For example, the first detection unit 667 can simultaneously detect both of a contact state and a short-circuit state by determining detected levels (L, L), (L, H) and (H, L), each representing a combination of levels having been detected at the two timings (t1, t2) shown in FIG. 8, as "a non-contact state", "a normal-contact state", and "a short-circuit state shown in FIG. 6", respectively. Similarly, the second detection unit 670 can simultaneously detect both of a contact state and a short-circuit state by determining detected levels (L, L), (H, L) and (L, H), each representing a combination of levels having been detected at the two timings (t1, t2) shown in FIG. 8, as "a non-contact state", "a normal-contact state", and "a short-circuit state shown in FIG. 7", respectively.

Hereinbefore, some examples of this embodiment have been described, and it can be understood easily by those skilled in the art that lots of modifications not substantially departing from new matters and effects of the invention can be made. Therefore, it is to be noted that all examples having such modifications are included within the scope of the invention. For example, any term described at least once together with a broader or synonymous different term in the specification or the drawings may be replaced by the different term at any place in the specification or the drawings.

The entire disclosure of Japanese Patent Application No. 2011-125991, filed on Jun. 6, 2011 is expressly incorporated herein by reference.

What is claimed is:

1. A printing apparatus comprising:

at least one printing material container which includes two first terminals, two second terminals, an electric device connected to the two first terminals, and a wiring connecting the two second terminals to each other, and which is attachable and detachable to the printing apparatus;

a first detection terminal and a second detection terminal which contact with the two first terminals, respectively, under the state where the at least one printing material container is attached to the printing apparatus;

a third detection terminal and a fourth detection terminal which contact with the two second terminals, respectively, under the state where the at least one printing material container is attached to the printing apparatus;

a first detection unit which is connected to the second detection terminal, and which detects contacts between the first and second detection terminals and the respective two first terminals by detecting a first detection signal, which is output from the first detection terminal, via a first attachment detection path including the electric device and the two first terminals; and a second detection unit which is connected to the fourth detection terminal, and which detects contacts between the third and fourth detection terminals and the respective two second terminals by detecting a second detection signal, which is output from the third detection terminal, via a second attachment detection path including the wiring and the two second terminals, wherein the first detection unit detects a short circuit occurring between the second detection terminal and the third detection terminal on the basis of the second detection signal, and the second detection unit detects a short circuit occurring between the first detection terminal and the fourth detection terminal on the basis of the first detection signal.

2. The printing apparatus according to claim 1, wherein, in the case where a path, via which the second detection signal output from the third detection terminal transmits to the first detection unit, is defined as a first short-circuit path, and a path, via which the first detection signal output from the first detection terminal transmits to the second detection unit, is defined as a second short-circuit path, an impedance of the first attachment detection path is larger than an impedance of the first short-circuit path, and an impedance of the second attachment detection path is larger than an impedance of the second short-circuit path.

3. The printing apparatus according to claim 2, further comprising:

an electric current limitation resistor for limiting an amount of electric current of the second detection signal output from the third detection terminal.

4. The printing apparatus according to claim 3, further comprising:

an overvoltage detection unit configured to, when a high voltage having a voltage level higher than that of a voltage of the second detection signal is applied to the first detection terminal, detect whether a voltage having a voltage level higher than or equal to a predetermined voltage level is applied to at least one of the third detection terminal and the fourth detection terminal, or not.

5. The printing apparatus according to claim 1, further comprising:

at least one discharging element configured to discharge electric charges stored in a capacitive element in advance of outputs of the first detection signal and the second detection signal, wherein the capacitive element is used for the electric device of the at least one printing material container in the case where the electric device is a sensor for detecting whether a remaining amount of a printing material contained in the at least one printing material container is more than or equal to a predetermined amount.

6. The printing apparatus according to claim 1, wherein the first detection terminal and the third detection terminal are located adjacent to each other, and the second detection terminal and the fourth detection terminal are located adjacent to each other.

* * * * *